US009660355B2

(12) United States Patent
Kato et al.

(10) Patent No.: US 9,660,355 B2
(45) Date of Patent: May 23, 2017

(54) CONNECTION STRUCTURE OF EXTERNAL CONDUCTOR TERMINAL OF ELECTRIC CABLE

(71) Applicant: YAZAKI CORPORATION, Tokyo (JP)

(72) Inventors: Hajime Kato, Kakegawa (JP); Kazuhiro Tomine, Kakegawa (JP); Takaaki Miyajima, Kakegawa (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 14/534,350

(22) Filed: Nov. 6, 2014

(65) Prior Publication Data

US 2015/0064992 A1 Mar. 5, 2015

Related U.S. Application Data

(63) Continuation of application No. PCT/JP2013/063237, filed on May 7, 2013.

(30) Foreign Application Priority Data

May 7, 2012 (JP) ..... 2012-106336

(51) Int. Cl.
*H01R 13/648* (2006.01)
*H01R 4/20* (2006.01)
(Continued)

(52) U.S. Cl.
CPC ..... *H01R 4/20* (2013.01); *H01R 9/0524* (2013.01); *H01R 13/6591* (2013.01); *H01R 9/0518* (2013.01); *H01R 13/04* (2013.01)

(58) Field of Classification Search
CPC .... H01R 4/646; H01R 9/032; H01R 13/5202; H01R 13/6592; H01R 24/38
(Continued)

(56) References Cited

U.S. PATENT DOCUMENTS 4,070,751 A * 1/1978 Hogendobler ..... H01R 9/0518 29/418
4,131,332 A * 12/1978 Hogendobler ..... H01R 9/0518 439/585
(Continued)

FOREIGN PATENT DOCUMENTS

DE 3108970 A1 10/1982
EP 1 128 472 A1 8/2001
(Continued)

OTHER PUBLICATIONS

International Search Report dated Aug. 6, 2013 in International Application No. PCT/JP2013/063237.
(Continued)

*Primary Examiner* — Abdullah Riyami
*Assistant Examiner* — Thang Nguyen
(74) *Attorney, Agent, or Firm* — Sughrue Mion, PLLC

(57) ABSTRACT

A connection structure of an external conductor terminal for connection with an external conductor of an electric cable including the external conductor made up of twined cables enclosing an outer periphery of an insulating coating of one or more internal conductors and a protective coating covering the external conductor, wherein the external conductor terminal has a cylindrical connector portion connected to the external conductor and a terminal portion provided at one end of the connector portion; and the connector portion is fitted around a location on an outer periphery of the insulating coating where the external conductor is laid bare, the twined cables of the external conductor are provided in contact with an outer periphery of the connector portion, a ring member is fitted around outer peripheries of the twined cables and the twined cables are crimped.

11 Claims, 11 Drawing Sheets

(51) Int. Cl.
*H01R 13/6591* (2011.01)
*H01R 9/05* (2006.01)
*H01R 13/04* (2006.01)

(58) Field of Classification Search
USPC ..... 439/99, 585, 607.41, 578, 583, 584, 439/607.42, 607.48, 607.5
See application file for complete search history.

(56) References Cited

U.S. PATENT DOCUMENTS

| | | | | |
|---|---|---|---|---|
| 6,261,108 | B1 * | 7/2001 | Kanagawa | H01R 13/6596 439/98 |
| 6,280,208 | B1 * | 8/2001 | Masuda | H01R 4/64 174/359 |
| 6,398,563 | B1 * | 6/2002 | Kanagawa | H01R 9/0518 439/587 |
| 6,419,521 | B2 * | 7/2002 | Kanagawa | H01R 13/6596 439/582 |
| 6,524,121 | B2 * | 2/2003 | Kanagawa | H01R 9/0518 439/95 |
| 6,558,172 | B2 * | 5/2003 | Kanagawa | H01R 9/0524 439/582 |
| 6,692,299 | B1 * | 2/2004 | Stockmaster | H01R 9/0518 439/578 |
| 7,893,354 | B2 * | 2/2011 | Albert | B60R 16/0222 174/72 A |
| 8,602,797 | B2 * | 12/2013 | Omae | H01R 9/0518 439/99 |
| 2002/0106918 | A1 | 8/2002 | Saito et al. | |
| 2008/0119088 | A1 * | 5/2008 | Noh | H01R 9/0518 439/607.41 |
| 2010/0022126 | A1 * | 1/2010 | Miyashita | H01R 4/18 439/585 |
| 2015/0107896 | A1 | 4/2015 | Kato et al. | |

FOREIGN PATENT DOCUMENTS

| | | | |
|---|---|---|---|
| JP | 48-95194 | | 2/1972 |
| JP | 53-4195 | | 6/1976 |
| JP | 2001-257043 | A | 9/2001 |
| JP | 2001-313100 | A | 11/2001 |
| JP | 2002-218622 | A | 8/2002 |
| WO | 2013/165024 | A1 | 11/2013 |

OTHER PUBLICATIONS

Written Opinion dated Aug. 6, 2013 in International Application No. PCT/JP2013/063237.
Communication dated Jan. 12, 2016, from the Japanese Patent Office in counterpart application No. 2012-106336.
Communication dated Feb. 16, 2017, from the European Patent Office in counterpart European Application No. 13723992.7.

* cited by examiner

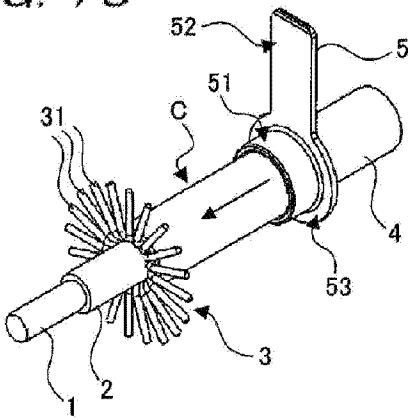
FIG. 7C
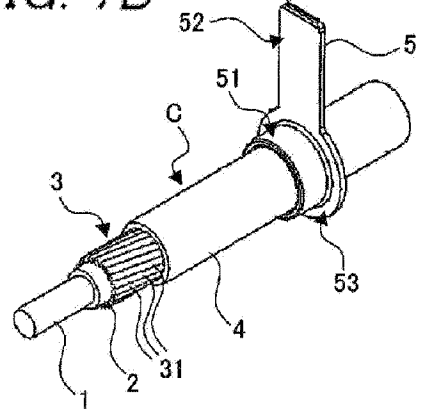
FIG. 7B
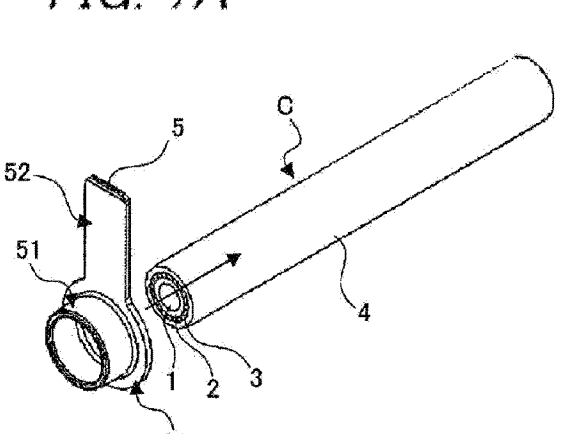
FIG. 7A
FIG. 7D
FIG. 7E
FIG. 7F

CONNECTION STRUCTURE OF EXTERNAL CONDUCTOR TERMINAL OF ELECTRIC CABLE

CROSS REFERENCE TO RELATED APPLICATIONS

This application is a continuation of PCT application No. PCT/JP2013/063237, which was filed on May 7, 2013 based on Japanese patent application (patent application 2012-106336) filed on May 7, 2012, whose contents are incorporated herein by reference. Also, all the references cited herein are incorporated as a whole.

BACKGROUND OF THE INVENTION

1. Technical Field

The invention relates to a connection structure of an external conductor terminal of an electric cable and, more particularly, to a connection structure of an external conductor terminal to be connected to an external conductor wound, in an enclosing manner, around an outer periphery of a single cable or multiple cables.

2. Background Art

A coaxial electric cable (which is referred to also as a "shielded electric cable) has widely been used as an electric cable for a region that requires a shield against electromagnetic waves, and the like; for instance, an electric cable for wiring among electric units of an automobile, and the like (see Japanese Patent Publication No. JP-A-2002-218622). The coaxial electric cable has a configuration in which one or a plurality of internal conductors (core cables) are sheathed with an insulating coating (an internal insulator) and in which an external conductor provided around an outer periphery of the insulating coating is covered with a protective coating (an external insulator). In the coaxial electric cable, an external conductor terminal to be brought into an electrical conduction with another circuit (e.g., a circuit for a connection with an electric part of an electric unit, or the like) is connected to the external conductor. When the external conductor terminal is connected to the external conductor, the protective coating of the coaxial electric cable is peeled off from its one end to a predetermined length, thereby laying the external conductor bare. The external conductor terminal is connected to the thus-bared area of the external conductor.

SUMMARY

In relation to the coaxial electric cable, the external conductor is fabricated as a braided cable that is formed by braiding conductive cables, like copper cables, into a mesh pattern or is fabricated by winding a plurality of conductive cables (twined cables) around an outer periphery of an insulating coating into a helical pattern along a lengthwise direction of the coaxial electric cable. For instance, in cases where the external conductor is fabricated from a plurality of helically wound conductive cables, on occasions when such an external conductor is connected to the external conductor terminal, the plurality of helically-wound conductive cables are loosened and feazed, then pulled out in a predetermined direction, and again twined. The external conductor terminal is connected to a leading end of the conductive cables.

Since the plurality of conductive cables are pulled out and twined as mentioned above, the external conductor is not covered with the protective coating, so that an externally-bared portion of the external conductor becomes long.

Moreover, work for winding a plurality of conductive cables which will make up an external conductor and twining the conductive cables together becomes necessary. This may worsen wiring work and work for assembling electrical units. Further, a defect might occur in a connection between the external conductor and the external conductor terminal depending on the manner in which the conductive cables are twined.

The invention has been conceived in light of the circumstances, and a challenge to solve the problem is met by making narrow a bare portion of an external conductor in a connection with an external conductor terminal, making connection work efficient, and enhancing connection quality.

According to one aspect of the present invention, there is provided a connection structure of an external conductor terminal for connection with an external conductor of an electric cable, the electric cable including the external conductor made up of twined cables provided so as to enclose an outer periphery of an insulating coating of one or a plurality of internal conductors and a protective coating which covers an outer periphery of the external conductor, wherein the external conductor terminal has a cylindrical connector portion to be connected to the external conductor and a terminal portion provided at one end of the connector portion in its cylinder axis direction;

the connector portion of the external conductor terminal is fitted around a location on an outer periphery of the insulating coating where the external conductor is laid bare by peeling off the protective coating or an outer periphery of the protective coating at another location contiguous to the location, the twined cables of the external conductor are provided in contact with an outer periphery of the connector portion, and a ring member is fitted around outer peripheries of the twined cables and the twined cables of the external conductor are crimped to the outer periphery of the connector portion.

According to this, since the twined cables of the external conductor are crimped to the connector portion while the ring member is fitted around the twined cables, a bared portion of the external conductor achieved after crimping can be restricted solely to a gap between the ring member and the protective coating in the lengthwise direction of the electric cable.

The terminal portion may assume a shape of a flat plate in a direction that crosses the cylinder axis direction of the connector portion and may be stretched from a brim at one end of the connector portion in a direction of diameter expansion.

The ring member may have a diameter-expanded flange that juts out from a brim of an opening at one end in a direction of diameter expansion or, in addition to having the diameter-expanded flange, a diameter-reduced flange that juts out from a brim of an opening at the other end in a direction of diameter reduction.

BRIEF DESCRIPTION OF THE DRAWINGS

FIGS. 1A to 1E are drawings showing a connection structure of a first embodiment of the invention, wherein FIG. 1A is a drawing showing a state in which an electric cable is caused to pass, from its cable end side, through a ring member, FIG. 1B is a drawing showing a state of the electric cable achieved after passes through the ring member, FIG. 1C is a drawing showing a state of the electric cable achieved after the electric cable passes through the external conductor terminal, FIG. 1D is a drawing showing a state of the electric cable achieved after the ring member moves to the cable end side of the electric cable, and FIG. 1E is a drawing showing a state of the electric cable achieved after the ring member is fitted around outer peripheries of twined cables of an external conductor (twined cables are crimped to an outer periphery of the connector portion, and the external conductor terminal and the external conductor are interconnected);

FIGS. 3A and 3B are drawings showing an example of a configuration of the external conductor terminal, wherein FIG. 3A is a drawing showing an example of a configuration of a terminal formed by drawing a flat conductor plate, and FIG. 3B is a drawing showing an example of a configuration of a terminal formed by curling the flat conductor plate;

FIGS. 5A and 5B are drawings showing a connection structure in which twined cables are crimped around the outer periphery of the connector portion without swaging the ring member, wherein FIG. 5A is a drawing showing a state of the electric cable achieved after there is performed work operation that is the equivalent of the work operation shown in FIGS. 1A and 1B, and FIG. 5B is a drawing showing a state of the electric cable achieved after the ring member moves to the cable end side of the electric cable (a state in which the twined cables are crimped to the outer periphery of the connector portion, and the external conductor terminal and the external conductor are interconnected);

FIGS. 7A to 7F are drawings showing a connection structure of a second embodiment of the invention, wherein FIG. 7A is a drawing showing a state in which the electric cable is caused to pass, from its cable end side, through the external conductor terminal, FIG. 7B is a drawing showing a state of the electric cable achieved after passes through the external conductor terminal, FIG. 7C is a drawing showing a state of the electric cable achieved after an external conductor and an internal conductor are laid bare, FIG. 7D is a drawing showing a state of the electric cable achieved after the external conductor terminal is moved to the cable end side of the electric cable, FIG. 7E is a drawing showing a state of the electric cable achieved after the electric cable passes through the ring member; and FIG. 7F is a drawing showing a state of the electric cable achieved after the ring member is fitted around turned-up outer peripheries of the twined cables (a state in which the twined cables are crimped to an outer periphery of the connector portion, to thus hold the external conductor terminal and the external conductor interconnected);

FIGS. 10A and 10B are drawings showing a connection structure in which twined cables are crimped around an outer periphery of the connector portion without swaging the ring member, wherein FIG. 10A is a drawing showing a state of the electric cable achieved after work operation that is the equivalent of the work shown in FIGS. 7A to 7C is performed, and FIG. 10B is a drawing showing a state achieved after the electric cable passes through a ring member (a state in which the twined cable is crimped around an outer periphery of the connector portion, to thus hold the external conductor terminal and the external conductor interconnected)

DETAILED DESCRIPTION OF EMBODIMENTS

A structure of the invention for connecting an external conductor terminal to an external conductor of an electric cable (hereinafter simply called a "connection structure") is hereunder described by reference to the accompanying drawings. The invention relates to a connection structure of an external conductor terminal to be connected to an external conductor of an electric cable. A conceivable electric cable is a coaxial electric cable, and the like, to be utilized as an electric cable for wiring in an area that needs shielding against electromagnetic waves, and the like, (e.g., an area in an electrical unit of an automobile, and the like).

Figure 1C:
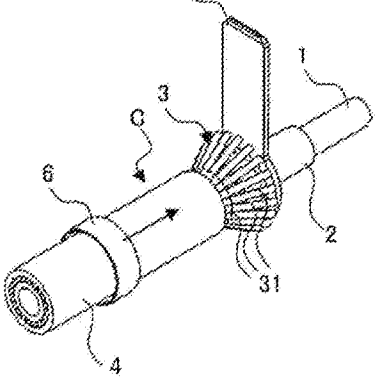
Figure 1B:
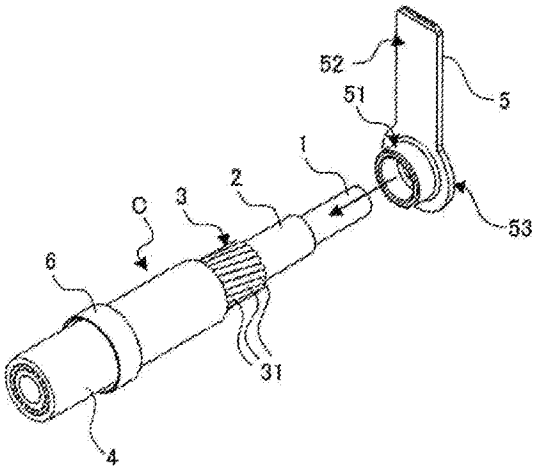
Figure 1A:
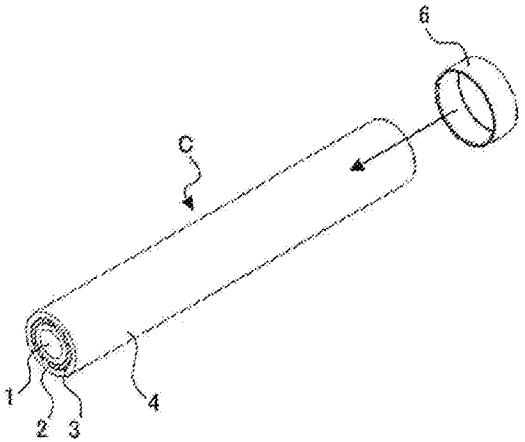
Figure 1E:
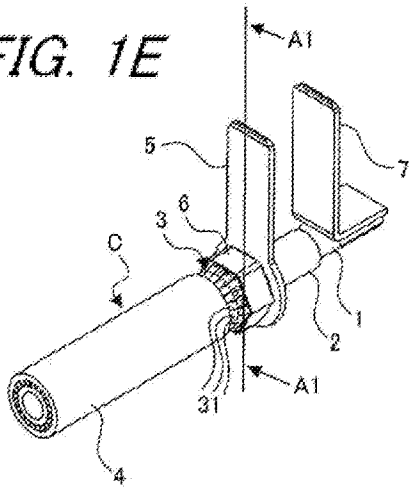
Figure 1D:
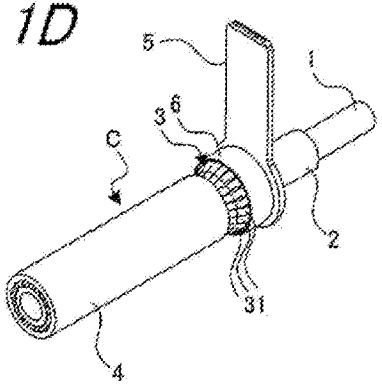
Figure 2:
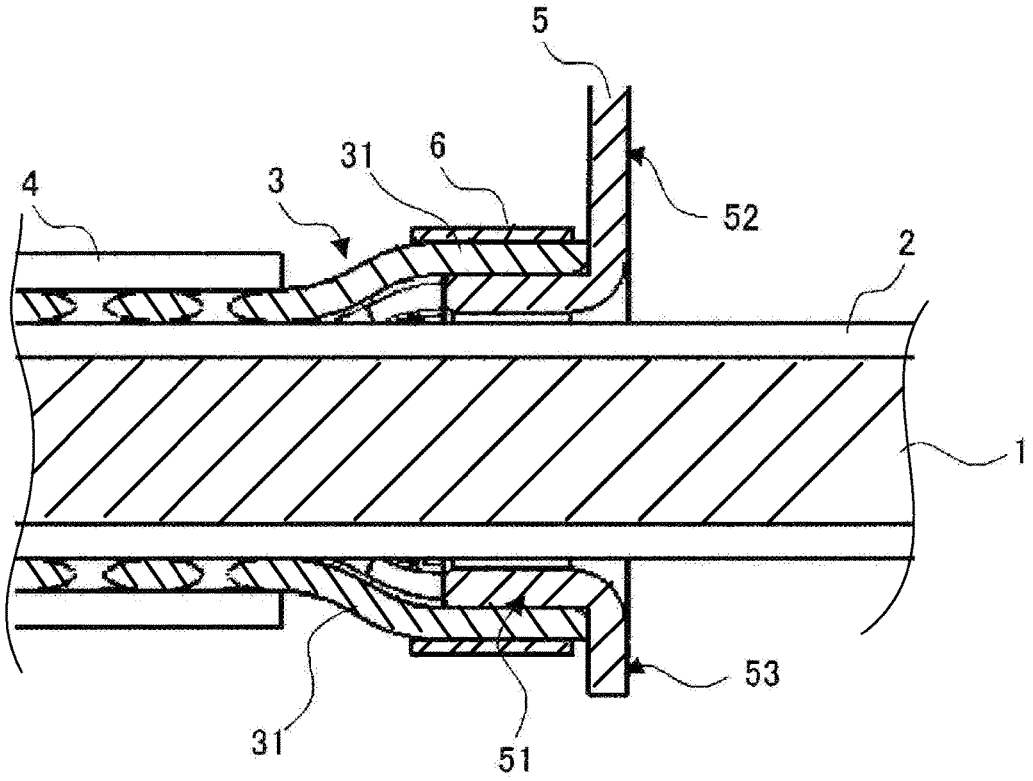
FIG. 2 is a drawing showing a longitudinal cross sectional view of a point designated by arrows A1 shown in FIG. 1E when viewed in a direction of the arrows.

FIGS. 1A to 1E and FIG. 2 show a connection structure of the first embodiment of the invention. FIGS. 1A to 1E are drawings showing the connection structure along an example of procedures for connecting an external conductor terminal to an external conductor of an electric cable. FIG. 2 is a drawing that shows, in a direction of arrows, a longitudinal cross sectional view of a point designated by arrows A1 shown in FIG. 1E that shows a state of the connection structure achieved after the external conductor terminal is connected to the external conductor of the electric cable.

As shown in FIGS. 1A to 2, an electric cable C of the embodiment includes an external conductor 3 that is formed from twined cables 31 wound around an outer periphery of an insulating coating 2 of one or a plurality of internal conductors 1 and a protective coating 4 provided so as to cover an outer periphery of the external conductor 3. In this case, the insulating coating (hereinafter called an "internal insulator") 2 and the protective coating (hereinafter called an "external insulator") 4 are made of an insulating material (for instance, resins, like polyethylene, vinyl chloride, and silicone). Specifically, the electric cable C is formed as a so-called a coaxial electric cable that is suitable for being utilized at an area which needs shielding against electromagnetic waves, and the like. For instance, the electric cable C can be used for a DC circuit while the internal conductor 1 is taken as a positive potential, and the external conductor 3 is taken as a negative potential (or the internal conductor 1 is taken as a negative potential, and the external conductor 3 is taken as a positive potential). Moreover, the electric cable C can be used for three-phase AC circuitry or single-phase three-line circuitry, so long as the electric cable C has a plurality of internal conductors 1. The external conductor 3 is made up of the plurality of twined cables 31. The twined cables 31 are wound around the outer periphery of the internal insulator 2 so as to assume a helical pattern along the lengthwise direction of the electric cable C. In the connection structure of the embodiment, an external conductor terminal (a terminal for connection with an electric part of an electrical unit in; for instance, an automobile) is connected to the external conductor 3 made up of the plurality of twined cables 31.

Figure 3A:
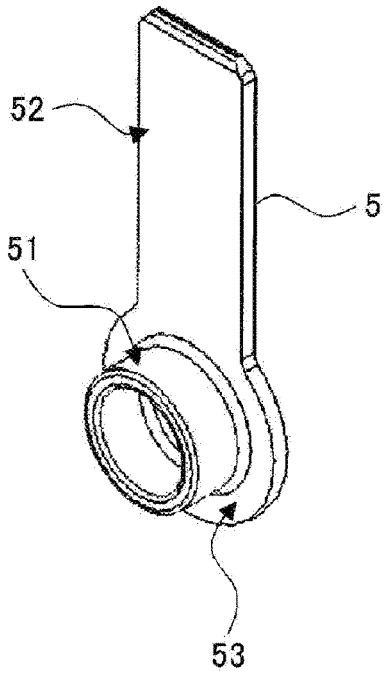
Figure 3B:
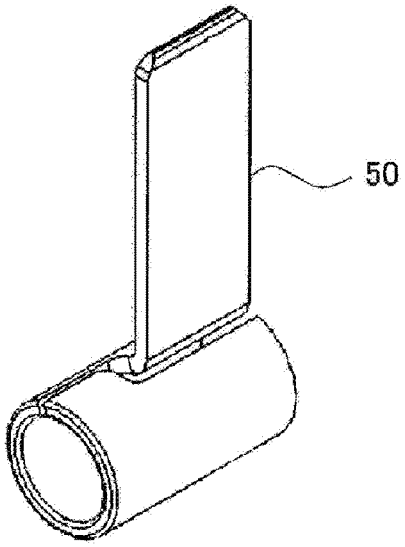

FIGS. 3A and 3B show an example of a configuration of the external conductor terminal. FIG. 3A shows an example of a configuration of a terminal (a terminal 5) formed from a flat conductor plate by means of drawing. FIG. 3B is a drawing showing an example of a configuration of a terminal (a terminal 50) formed from a flat conductor plate by means of curling. In the embodiment, explanations are given to, by way of example, a case where the terminal 5 shown in FIG. 3A is used as an external conductor terminal. In this respect, the terminal 50 shown in FIG. 3B can also be used as an external conductor terminal.

The external conductor terminal 5 has a cylindrical connector portion 51 to be connected to the external conductor 3 and a terminal portion 52 provided at one end of the connector portion 51 along its cylinder axis direction. In this case, the connector portion 51 assumes a cylindrical shape whose inner diameter is set so as to become larger than a diameter of the internal insulator 2 of the electric cable C. Moreover, the connector portion 51 has a flange (a disk-shaped projection) 53 that juts out in a direction of diameter expansion from one end of the connector portion in its cylinder axis direction; namely, from an entire circumference of a brim of an opening at one end where the terminal portion 52 is provided. A length of the connector portion 51 achieved in the axial direction of the cylindrical shape is set according to a length of a ring member 6 to be described later (a distance between openings at both ends of the ring member) so that the twined cables 31 of the external conductor 3 can be crimped to an outer periphery of the connector portion 51 without fail.

Figure 4:
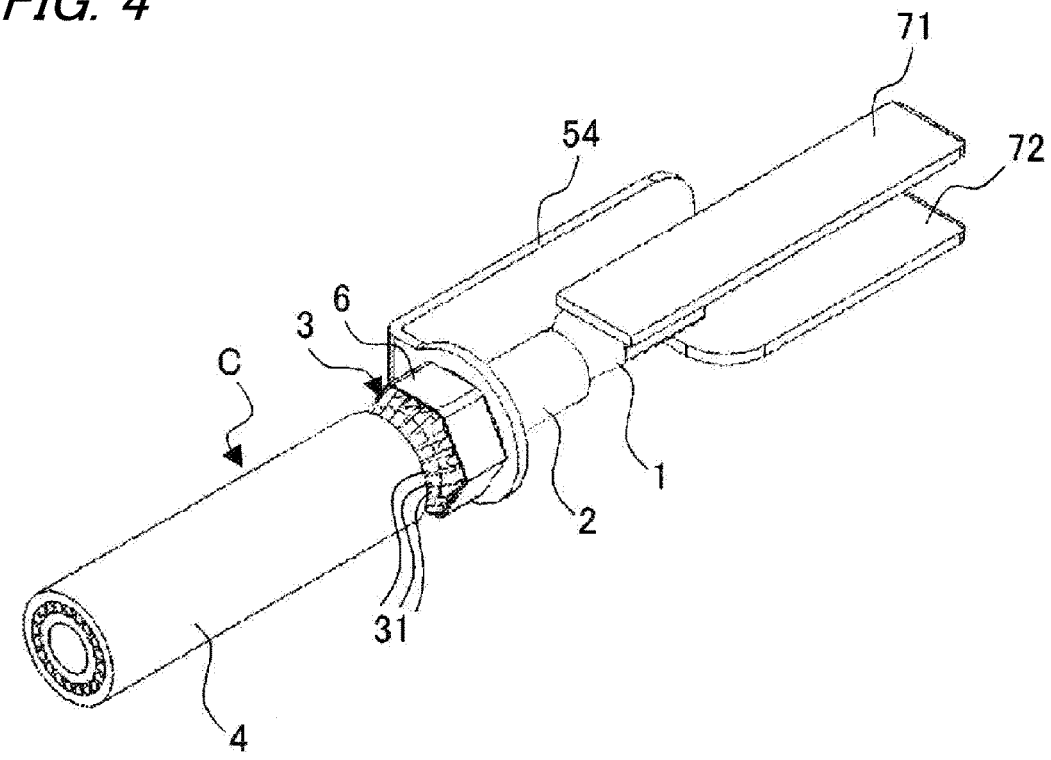
FIG. 4 is a drawing showing another form of a terminal portion of the external conductor terminal.

The terminal portion 52 is a terminal for connection purpose that pairs up with the internal conductor terminal 7 connected to an internal conductor 1 of the electric cable. The terminal portion 52 assumes the shape of a flat plate in a direction that crosses the cylinder axis direction of the connector portion 51, stretching from the brim at one end of the connector portion 51 in the direction of diameter expansion. In the embodiment, the terminal portion 52 is made so as to stretch in the shape of a flat plate from the flange 53 of the connector portion 51 in the direction of diameter expansion. The terminal portion 52 is not particularly limited to a shape, such as that shown in FIG. 3A, and can assume any arbitrary shape according to a shape of its counterpart terminal to be connected. For instance, as shown in FIG. 3B, the terminal portion 52 can also be stretched in the form of a flat plate along the cylinder axis direction of the connector portion. Alternatively, as shown in FIG. 4, the terminal portion can also be formed as an L-shaped terminal portion 54 that juts out from the brim of the flange in the direction of diameter expansion and is bent along the lengthwise direction of the electric cable C to thus stretch in the form of a flat plate along the lengthwise direction.

In relation to the external conductor terminal 5 and the external conductor 3 of the electric cable C that have the configurations such as those mentioned above, the connector portion 51 of the external conductor terminal 5 is fitted around an outer periphery of the internal insulator 2 where the external conductor 3 are laid bare by peeling off the external insulator 4. The twined cables 31 of the external conductor 3 are placed in contact with an outer periphery of the connector portion 51. The ring member 6 is fitted around the outer peripheries of the twined cables 31, whereby the twined cables 31 of the external conductor 3 are crimped to the outer periphery of the connector portion 51. A structure that makes such a connection between the external conductor terminal 5 and the external conductor 3 of the electric cable C is hereunder specifically described along connection procedures shown in FIGS. 1A to 1E. In the following descriptions, an end of the electric cable C in its lengthwise direction where the external insulator 4 is peeled off to lay the external conductor 3 bare during connection of the external conductor terminal 5 is called a cable end side, whilst the other end of the electric cable C with respect to the cable end side is called a cable base end side (the same applies to any counterparts in the following descriptions pertaining to a second embodiment).

On occasions when the external conductor terminal 5 is connected to the external conductor 3 of the electric cable C, the electric cable C is first inserted into the ring member 6. FIG. 1A shows an example case where the cable end side of the electric cable C is inserted into the ring member 6. However, the cable base end side of the electric cable C can also be inserted into the ring member 6. The ring member 6 is a member that has an inner diameter which is larger than the diameter of the electric cable C (the external insulator 4) and that can be easily deformed in a direction of diameter reduction by swaging an outer periphery of the member along its entire circumference. For instance, a metal ring, and the like, can be used.

FIG. 1B shows a state of the electric cable C achieved after passes through the ring member 6. As shown in FIG. 1B, a location up to which the ring member 6 fitted around the electric cable C is to be moved is previously adjusted in such a way that the ring member 6 is placed in closer proximity to the cable base end side than to an area where the external insulator 4 is peeled off from the cable end side to thereby lay the external conductor 3 bare. After the ring member is moved to the cable base end side, the external insulator 4 and the internal insulator 2 on the cable end side are peeled off, to thus lay the external conductor 3 and the internal conductor 1 bare. On this occasion, the external insulator 4 and the internal insulator 2 are peeled off, and the length of a bared area of the external conductor 3 is adjusted in such a way that the internal insulator 2 is laid bare in closer proximity to the cable end side than is the thus-bared external conductor 3 and that the internal conductor 1 is laid bare in closer proximity to the cable end side than is the thus-bared internal insulator 2. For instance, the length of the bared area of the external conductor 3 is set so as to become slightly larger than the length of the connector portion 51 of the external conductor terminal 5 in its cylinder axis direction (i.e., a distance between openings at both ends). The essential requirement for the length is to be controlled in such a way that a leading end of the bared area comes into contact with the flange 53 of the connector portion 51 while the twined cables 31 remain crimped to the outer periphery of the connector portion 51 (see FIG. 2). So long as the length of the bared area is set to such a length, a leading end of the bared area will not interfere with the flange 53 during work for fitting the external conductor terminal 5, and the work can be easily performed. After the external conductor 3 and the internal conductor 1 have been laid bare as mentioned above, the cable end side of the electric cable C is inserted into the external conductor terminal 5. In relation to the external conductor terminal 5, the electric cable C is at this time inserted into the connector portion 51 from the opening on the other side of the flange 53, thereby positioning the flange 53 and the terminal portion 52 at the cable end side. In the embodiment, as shown in FIGS. 1A and 1B, the electric cable C is inserted into the ring member 6 before the external conductor 3 and the internal conductor 1 are laid bare. However, the electric cable C may also be inserted into the ring member 6 even after the external conductor 3 and the internal conductor 1 have been laid bare. In this regard, the direction of insertion of the electric cable C and a sequence of insertion of the ring member 6 and the external conductor terminal 5 are adjusted such that the ring member 6 is placed in closer proximity to the cable base end side than is the external conductor terminal 5.

FIG. 1C shows a state of the electric cable C achieved after the electric cable C passes through the external conductor terminal 5. As shown in FIG. 1C, in relation to the external conductor 3, the plurality of twined cables 31 laid bare while being helically wound (as shown in FIG. 1B) are loosened and feazed. The external conductor terminal 5 fitted around the electric cable C is moved toward the cable base end side up to a location on the outer periphery of the internal insulator 2 where the external insulator 4 is peeled off to thus lay the external conductor 3 (the plurality of twined cables 31) bare. On this occasion, in relation to the external conductor terminal 5, the connector portion 51 is fitted around the outer periphery of the internal insulator 2 while the twined cables 31 of the external conductor 3 remain in contact with the outer periphery of the connector portion 51. Specifically, the external conductor terminal 5 is positioned in such a way that the connector portion 51 is fitted to a location between the twined cables 31 of the bared external conductor 3 and the outer periphery of the internal insulator 2, whereby the connector portion 51 is interposed between the external conductor 3 and the internal insulator 2. In other words, the minimum requirement is to insert the electric cable C into the external conductor terminal 5 in such a way that the opening of the connector portion 51 on the other side of the flange 53 comes to a neighborhood of the base end of the bared areas of the twined cables 31. Therefore, the external conductor terminal 5 can be easily positioned. As above, after the external conductor terminal 5 is placed, the ring member 6 that is placed in closer proximity to the cable base end side than to the area where the external conductor 3 (the plurality of the twined cables 31) are laid bare is moved toward the cable end side along the electric cable C.

FIG. 1D shows a state of the electric cable C achieved after the ring member 6 is moved toward the cable end side. As shown in FIG. 1D, the ring member 6 is moved toward the cable end side, fitting around the outer peripheries of the twined cables 31 of the external conductor 3 that is placed in contact with the outer periphery of the connector portion 51. Specifically, the ring member 6 is placed in such a way that the twined cables 31 of the external conductor 3 are sandwiched between an inner periphery of the ring member 6 and the outer periphery of the connector portion 51 of the external conductor terminal 5.

FIG. 1E shows a state of the electric cable C achieved after the ring member 6 fits around the outer peripheries of the twined cables 31 of the external conductor 3. As shown in FIG. 1E, an outer periphery of the ring member 6 is swaged along its entire circumference while fitting around the outer peripheries of the twines cables 31 of the external conductor 3; namely, while the twined cables 31 are sandwiched between the inner periphery of the ring member 6 and the outer periphery of the connector portion 51, to thereby become deformed in the direction of diameter reduction. FIG. 1E shows, by way of example, a state achieved after the ring member 6 is swaged such that an outer shape of the ring member 6 becomes hexagonal. In this state, as shown in FIG. 2, the ring member 6 is crimped to the outer periphery of the internal insulator 2 of the electric cable C by way of the twined cables 31 of the external conductor 3 and the connector portion 51 of the external conductor terminal 5. As a consequence, the twined cables 31 are crimped to the outer periphery of the connector portion 51, thereby enabling interconnection of the external conductor terminal 5 with the external conductor 3. As above, since the twined cables 31 of the external conductor 3 can be crimped to the connector portion 51 while the ring member 6 remains fitted around the twined cables 31, the area of the external conductor 3 that has been laid bare after crimping can be held in only a gap between the ring member 6 and the external insulator 4 in the lengthwise direction of the electric cable.

The thus-bared intern conductor 1 is connected to the internal conductor terminal 7. A method for connecting the internal conductor terminal 7 to the internal conductor 1 is not limited to a particular technique, and any arbitrary technique can be adopted. For instance, the internal conductor terminal 7 can be connected to the internal conductor 1 by means of ultrasonic welding. FIG. 1E shows an example of a configuration of the internal conductor terminal 7 having a terminal portion that is stretched in the form of a flat plate in a direction which crosses the lengthwise direction of the electric cable C and that opposes in parallel to the external conductor terminal 5. However, the internal conductor terminal 7 is not limited to the example configuration but can assume any arbitrary shape in conformity with a shape of its counterpart terminal to be connected. For instance, as shown in FIG. 4, the internal conductor terminal can also be configured so as to have a plurality of terminal portions 71 and 72 that are stretched in the form of a flat plate along the lengthwise direction of the electric cable C.

Figure 5B:
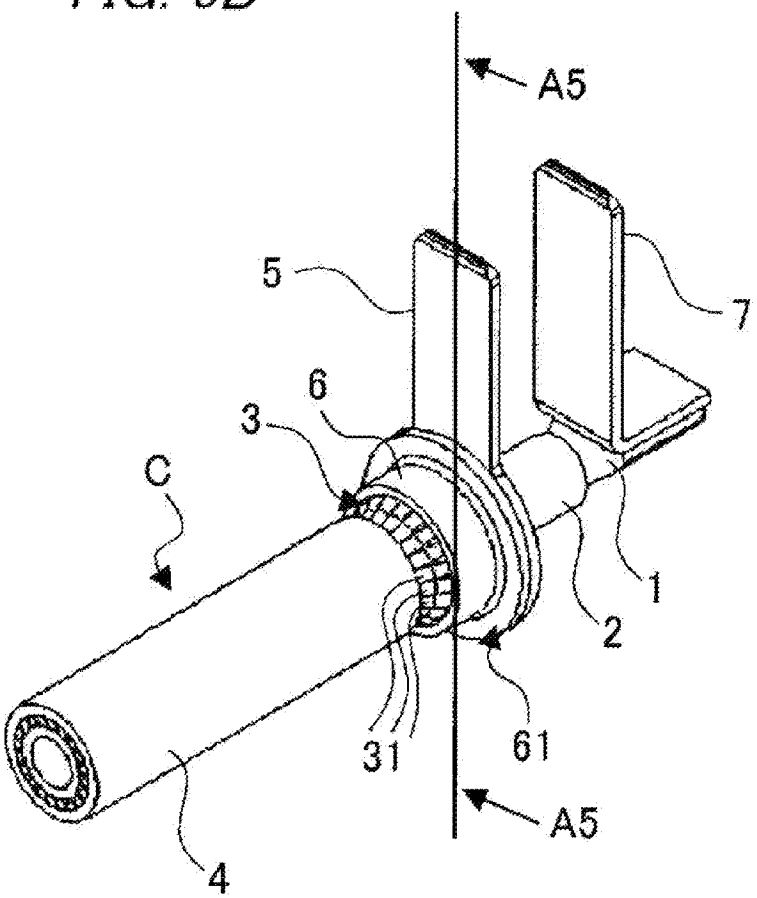
Figure 5A:
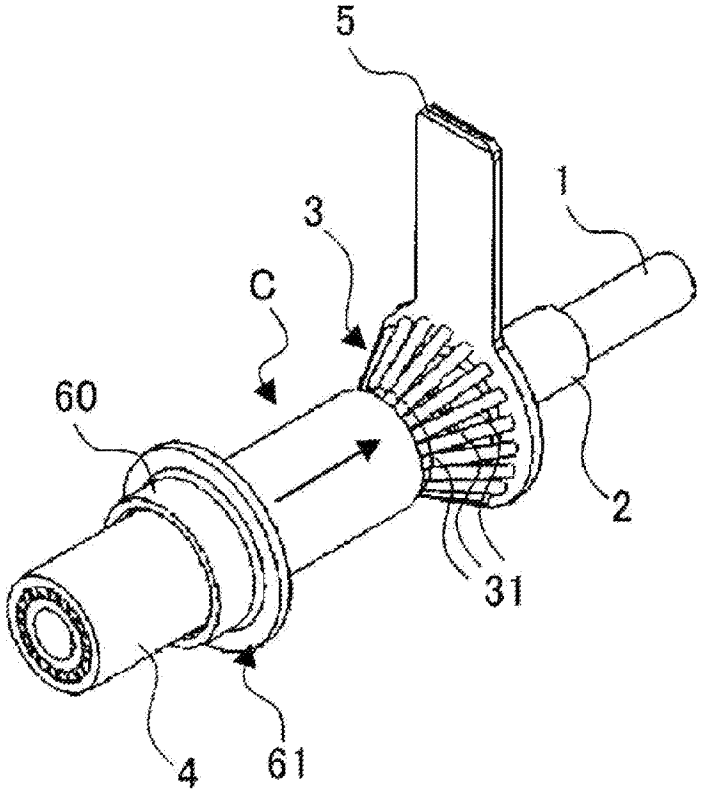
Figure 6:
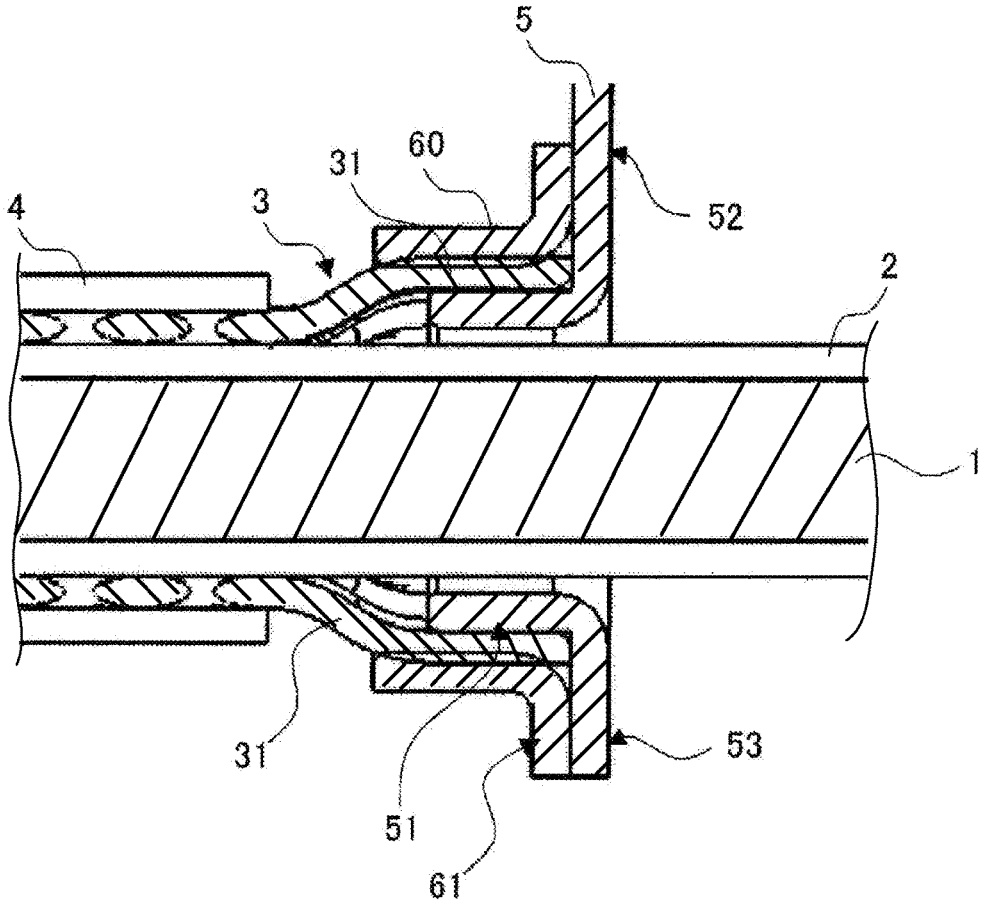
FIG. 6 is a drawing of a longitudinal cross sectional view of a point designated by arrows A5 in FIG. 5B when viewed in a direction of the arrows.

In the connection structure mentioned above, the twined cables 31 are crimped to the outer periphery of the connector portion 51 by swaging the ring member 6. However, there is nothing wrong with adopting a structure in which the twined cables 31 are crimped to the outer periphery of the connector portion 51 without swaging the ring member 6. FIGS. 5A and 5B and FIG. 6 show an example of a connection structure using such a ring member. FIGS. 5A and 5B are drawings showing the connection structure along an example of procedures for connecting the external conductor terminal 5 to the external conductor 3 of the electric cable C. FIG. 6 is a drawing that shows, in a direction of arrows, a longitudinal cross section of a point designated by arrows A5 in FIG. 5B which shows a state of the connection structure achieved after the external conductor terminal 5 is connected to the external conductor 3 of the electric cable C.

In this case, a ring member 60 is formed in a cylindrical shape whose inner diameter is set so as to become slightly larger than the diameter of the electric cable C (the external insulator 4) and has a diameter-expanded flange (a disk-shaped projection) 61 that juts out from an entire circumference of a brim of an opening at one end of the ring member 60 in its cylinder axis direction to a direction of diameter expansion. The essential requirement for a length to which the diameter-expanded flange 61 juts out is to be set in such a way that a circumference of the diameter-expanded flange 61 becomes flush with a circumference of the flange 53 while the diameter-expanded flange 61 is held in close contact with the flange 53 of the external conductor terminal 5 (see FIG. 6) when the ring member 60 is crimped to the outer periphery of the internal insulator 2 of the electric cable C by way of the twined cables 31 of the external conductor 3 and the connector portion 51 of the external conductor terminal 5.

On occasions when the external conductor terminal 5 using the ring member 60 is connected to the external conductor 3 of the electric cable C, work operation analogous to that shown in FIGS. 1A and 1B is first performed.

In this case, work operation has common details except the ring member 6 is replaced by the ring member 60.

FIG. 5A shows a state of the electric cable C achieved after work operation which is the equivalent of that shown in FIGS. 1A and 1B is performed by use of the ring member 60. In this state, as in the case with the electric cable shown in FIG. 1C, the external conductor terminal 5 is positioned such that the twined cables 31 of the external conductor 3 remain in contact with the outer periphery of the connector portion 51; namely, that the connector portion 51 is fitted to a location between the twined cables 31 of the bared external conductor 3 and the outer periphery of the internal insulator 2. After the external conductor terminal 5 is thus positioned, the ring member 60 that is positioned in closer proximity to the cable base end side than to the area where the external conductor 3 (the plurality of twined cables 31) are bared is moved along the electric cable C to the cable end side.

FIG. 5B shows a state of the electric cable C achieved after the ring member 60 is moved toward the cable end side. As shown in FIG. 5B, the ring member 60 is moved toward the cable end side, thereby fitting around the outer peripheries of the twined cables 31 of the external conductor 3 positioned in contact with the outer periphery of the connector portion 51. On the occasion, the ring member 60 is press-fitted toward the cable end side while bringing an inner periphery of the ring member 60 in contact with an outer peripheries of the twined cables 31 such that the twined cables 31 of the external conductor 3 are interposed between the inner periphery of the ring member 60 and the outer periphery of the connector portion 51 of the external conductor terminal 5. The ring member 60 is press-fitted toward the cable end side until the diameter-expanded flange 61 contacts the flange 53 of the external conductor terminal 5. As shown in FIG. 6, the diameter-expanded flange 61 comes into close contact with the flange 53 of the external conductor terminal 5 in this state, whereby the ring member 60 is crimped to the outer periphery of the internal insulator 2 of the electric cable C by way of the twined cables 31 of the external conductor 3 and the connector portion 51 of the external conductor terminal 5. As a consequence, the twined cables 31 are crimped to the outer periphery of the connector portion 51, so that the external conductor terminal 5 and the external conductor 3 can be connected to each other. Moreover, as in the case with the electric cable shown in FIG. 1E, the internal conductor terminal 7 is connected to the bared internal conductor 1. In this respect, the technique for connecting the internal conductor terminal 7 to the internal conductor 1 and the configuration of the internal conductor terminal 7 are analogous to their counterparts described in connection with the case of the connection structure that uses the aforementioned ring member 6.

The embodiment provides the connection structure in which the connector portion 51 of the external conductor terminal 5 is fitted around the outer periphery of the internal insulator 2 where the external conductor 3 is bared by peeling off the external insulator 4. However, in another acceptable connection structure, the connector portion 51 may be fitted around a location on the outer periphery of the external insulator 4 that is contiguous to the area where the external conductor 3 is laid bare. The connection structure in which the connector portion 51 is fitted around the outer periphery of the external insulator 4 is hereunder described as a second embodiment of the invention. An electric cable, an external conductor terminal, and a ring member of the connection structure of the second embodiment are analogous, in terms of a basic configuration, to their counterparts described in connection with the connection structure of the first embodiment (FIGS. 1A to 1E, FIG. 2, FIGS. 3A and 3B, FIG. 4, FIGS. 5A and 5B, and FIG. 6). Therefore, constituent members that are identical with or similar to their counterparts described in connection with the connection structure of the first embodiment are assigned the same reference numerals in the drawings, and their explanations are omitted. Detailed explanations are hereunder given to a configuration peculiar to the second embodiment.

Figure 8:
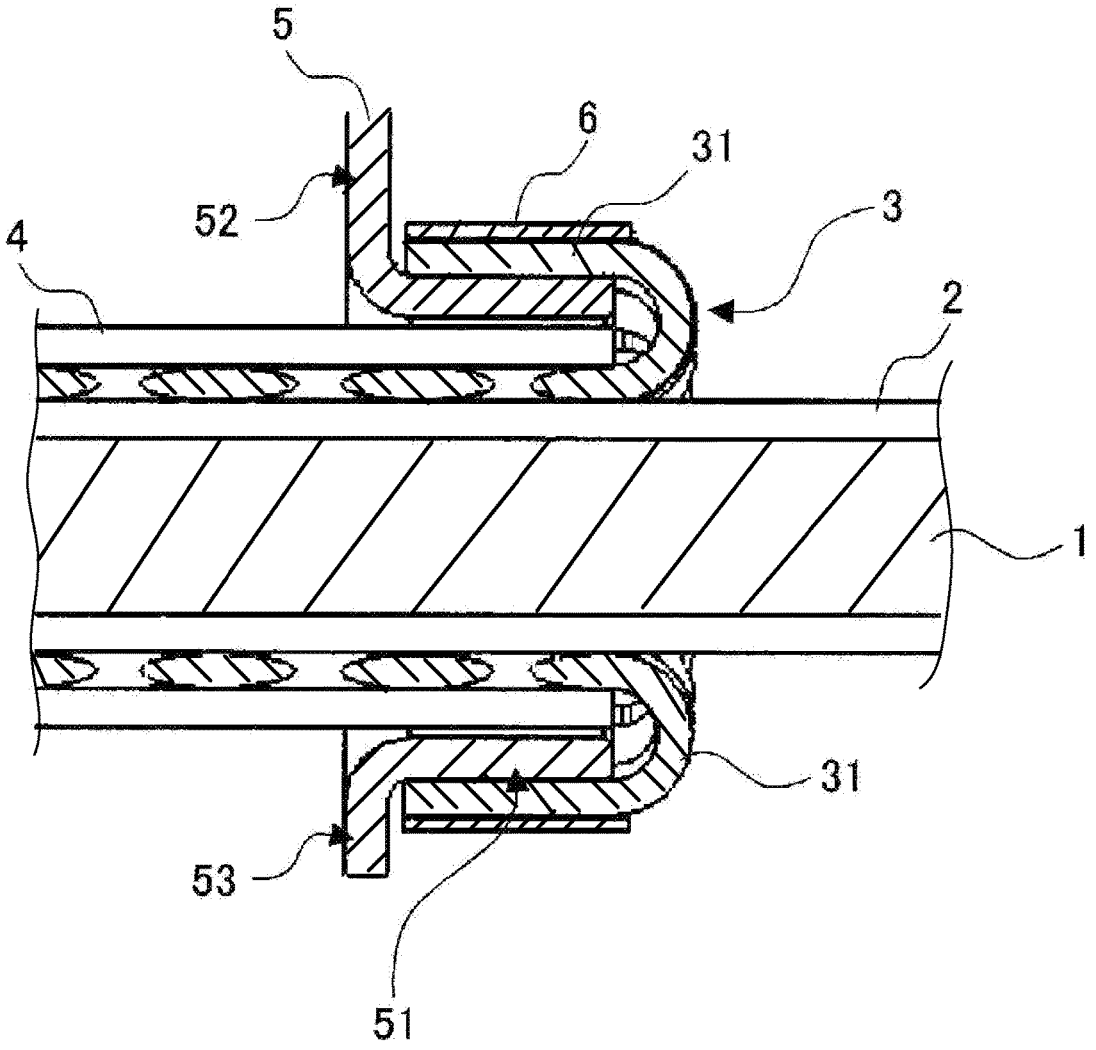
FIG. 8 is a drawing showing a longitudinal cross section of a point designated by arrows A7 shown in FIG. 7F when viewed in a direction of the arrows.

FIGS. 7A to 7F and FIG. 8 show the connection structure of the second embodiment of the invention. FIGS. 7A to 7F are drawings showing the connection structure along an example of procedures for connecting the external conductor terminal to the external conductor of the electric cable, and FIG. 8 is a drawing showing, in a direction of arrows, a longitudinal cross section of a point designated by arrows A7 shown in FIG. 7F that illustrates a state achieved after the external conductor terminal is connected to the external conductor of the electric cable.

The connection structure of the embodiment is specifically described along connection procedures shown in FIGS. 7A to 7F. On occasions when the external conductor terminal 5 is connected to the external conductor 3 of the electric cable C, the electric cable C is inserted into the external conductor terminal 5. FIG. 7A shows, by way of example, a case where the cable end side of the electric cable C is inserted into the external conductor terminal 5. However, the electric cable C can also be inserted from its cable base end side into the external conductor terminal 5. In the external conductor terminal 5, the electric cable C is inserted into the connector portion 51 from the opening on the part of the flange 53, and the flange 53 and the terminal portion 52 are placed on the cable base end side. In the embodiment, the connector portion 51 of the external conductor terminal 5 assumes a cylindrical shape whose inner diameter is set so as to become slightly larger than the diameter of the external insulator 4 of the electric cable C.

FIG. 7B shows the state of the electric cable C achieved after the electric cable C is inserted into the external conductor terminal 5. As shown in FIG. 7B, a position on the external conductor terminal 5 up to which the electric cable C is to be inserted is previously adjusted in such a way that the external conductor terminal 5 is placed in closer proximity to the cable base end side than to an area where the external insulator 4 is peeled off from the cable end side to thereby lay the external conductor 3 bare. After the external conductor terminal 5 is positioned toward the cable base end side, the external insulator 4 and the internal insulator 2 that are on the cable end side are peeled off, to thus lay the external conductor 3 and the internal conductor 1 bare. On this occasion, the external insulator 4 and the internal insulator 2 are peeled off, and the length of the bared area of the external conductor 3 is adjusted in such a way that the internal insulator 2 is laid bare in closer proximity to the cable end side than is the thus-bared external conductor 3 and that the internal conductor 1 is laid bare in closer proximity to the cable end side than is the thus-bared internal insulator 2. For instance, the essential requirement for the length of the bared area of the external conductor 3 is to be adjusted in such a way that the bared portion is turned up toward the cable base end side and that a leading end of the turn-up opposes the flange 53 of the connector portion 51 with a slight gap therebetween while the turned-up twined cables 31 remain crimped to the outer periphery of the connector portion 51 (see FIG. 8). So long as the length of the bared area is set to such a length, a leading end of a turned-up portion will not interfere with the flange 53 during work for turning up the external conductor 3, and the work can be easily performed. In the embodiment, as shown in FIGS. 7A and 7B, the electric cable C is inserted into the external conductor terminal 5 before the external conductor 3 and the internal conductor 1 are laid bare. However, the electric cable C can also be inserted into the external conductor terminal 5 even after the external conductor 3 and the internal conductor 1 have been laid bare.

FIG. 7C shows a state of the electric cable C achieved after the external conductor 3 and the internal conductor 1 are laid bare. As shown in FIG. 7C, in relation to the external conductor 3, the plurality of twined cables 31 laid bare while being helically wound (as shown in FIG. 7B) are loosened and feazed radially. The external conductor terminal 5 placed at a position in closer proximity to the cable base end side than to a location where the external conductor 3 (the plurality of twined cables 31) are laid bare is moved toward the cable end side along the electric cable C.

FIG. 7D shows a state of the electric cable C achieved after the external conductor terminal 5 moves to cable end side. As shown in FIG. 7D, the external conductor terminal 5 is moved toward the cable end side, thereby fitting around a location on the outer periphery of the external insulator 4 that is contiguous to the area where the external conductor 3 (the plurality of twined cables 31) are laid bare by peeling off the external insulator 4. All you have to do at this time is to insert the electric cable C into the external conductor terminal 5 such that the opening of the connector portion 51 that is on the other side of the flange 53 comes into contact with the radially-spread twined cables 31; hence, the external conductor terminal 5 can be easily positioned. The radially-spread twined cables 31 are turned toward the cable base end side so as to be positioned in contact with the outer periphery of the connector portion 51. Specifically, the external conductor terminal 5 is positioned such that the connector portion 51 is fitted to a location between the turned-up twined cables 31 of the external conductor 3 and the outer periphery of the external insulator 4, whereby the connector portion 51 is interposed between the external conductor 3 and the external insulator 4. As above, after the external conductor terminal 5 is placed, the ring member 6 is fitted around the electric cable C from its cable end side. In the embodiment, the inner diameter of the ring member 6 is set so as to become larger than the diameter of the area where the twined cables 31 of the external conductor 3 are placed in contact with the outer periphery of the connector portion 51 of the external conductor terminal 5 fitted around the outer periphery of the external insulator 4 of the electric cable C (i.e., the area of the turned-up twined cables 31). The ring member 6 is a member that can be easily deformed in a direction of diameter reduction by swaging an outer periphery of the ring member along its entire circumference. For instance, a metal ring, and the like, can be used in the same way as in the case of the connection structure described in connection with the first embodiment.

FIG. 7E shows a state of the electric cable C achieved after the electric cable is inserted into the ring member 6. As shown in FIG. 7E, the ring member 6 into which the electric cable C is inserted is moved toward the cable base end side along the electric cable C, fitting around the outer peripheries of the twined cables 31 of the external conductor 3 turned so as to come into contact with the outer periphery of the connector portion 51. Specifically, the ring member 6 is placed in such a way that the twined cables 31 of the external conductor 3 are sandwiched between an inner periphery of the ring member 6 and the outer periphery of the connector portion 51 of the external conductor terminal 5.

FIG. 7F shows a state of the electric cable C achieved after the ring member 6 fits around the turned-up outer peripheries of the twined cables 31. As shown in FIG. 7F, an outer periphery of the ring member 6 is swaged along its entire circumference while fitting around the outer peripheries of the turned-up twined cables 31; namely, while the twined cables 31 are sandwiched between the inner periphery of the ring member 6 and the outer periphery of the connector portion 51, to thereby become deformed in the direction of diameter reduction. FIG. 7F shows, by way of example, a state achieved after the ring member 6 is swaged such that an outer shape of the ring member 6 becomes hexagonal. In this state, as shown in FIG. 8, the ring member 6 is crimped to the outer periphery of the external insulator 4 of the electric cable C by way of the twined cables 31 of the external conductor 3 and the connector portion 51 of the external conductor terminal 5. As a consequence, the turned-up twined cables 31 are crimped to the outer periphery of the connector portion 51, thereby enabling interconnection of the external conductor terminal 5 with the external conductor 3. As above, since the twined cables 31 of the external conductor 3 can be crimped to the connector portion 51 while the ring member 6 remains fitted around the twined cables 31, the area of the external conductor 3 that has been laid bare after crimping can be held on only the turned-up portions of the twined cables 31.

Figure 9:
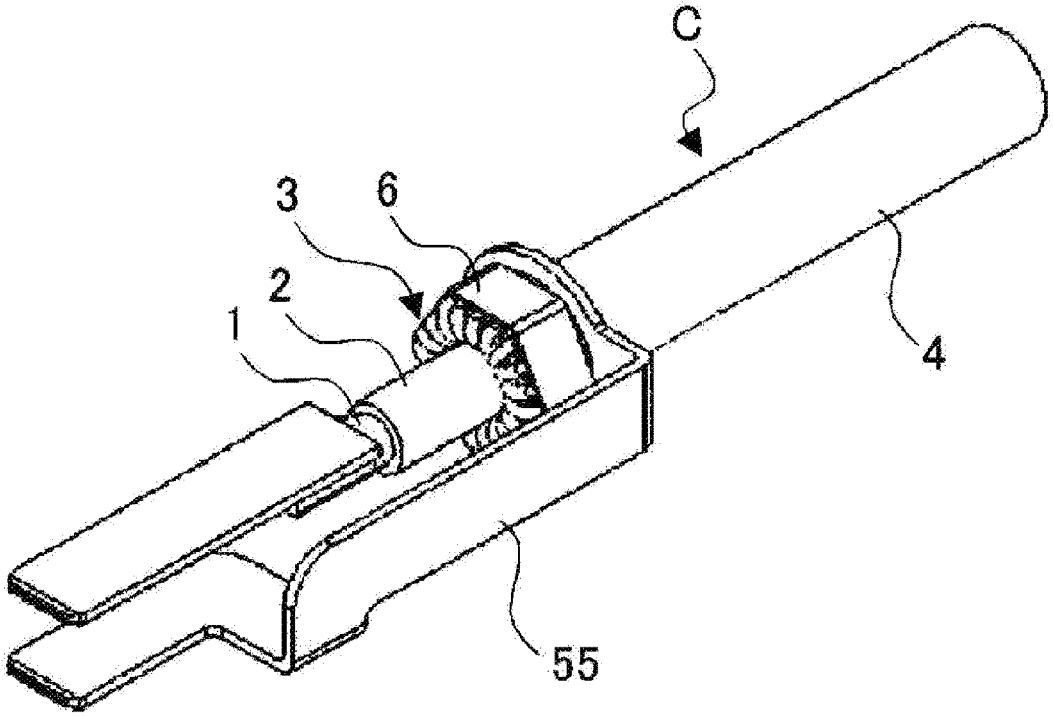
FIG. 9 is a drawing showing another shape of a terminal portion of the external conductor terminal.

In the embodiment, the terminal portion 52 of the external conductor terminal 5 is not particularly limited to the shapes, such as those shown in FIGS. 7A to 7F, and can assume any arbitrary shape according to a shape of its counterpart terminal to be connected. For instance, as shown in FIG. 9, the terminal portion 52 can also be embodied as a terminal portion 55. Namely, the terminal portion 55 juts out from a brim of the opening on one end of the connector portion 51 in the direction of diameter expansion, has a turn in the cylinder axis direction of the connector portion 51, another turn in a direction that crosses the cylinder axis direction, and still another turn in, again, the cylinder axis direction, and stretches in a form of a flat plate along the cylinder axis direction. The internal conductor terminal 7 is connected to the bared internal conductor 1. In this respect, the technique for connecting the internal conductor terminal 7 to the internal conductor 1 and handling the configuration of the internal conductor terminal 7 are analogous to their counterparts described in connection with the case of the connection structure of the first embodiment (see FIG. 1E).

Figure 10B:
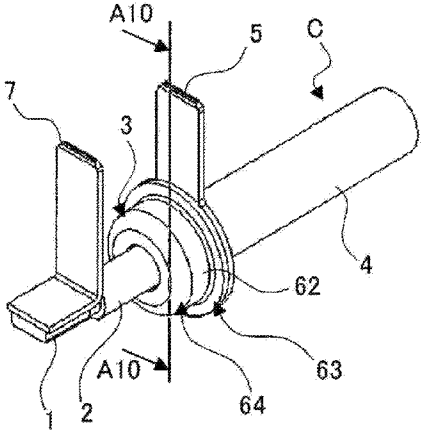
Figure 10A:
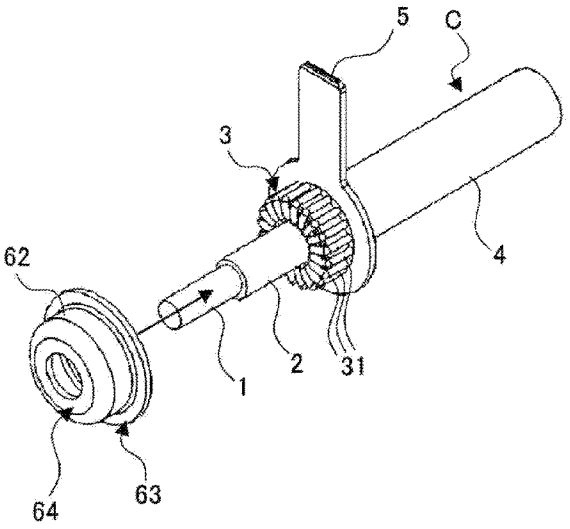
Figure 11:
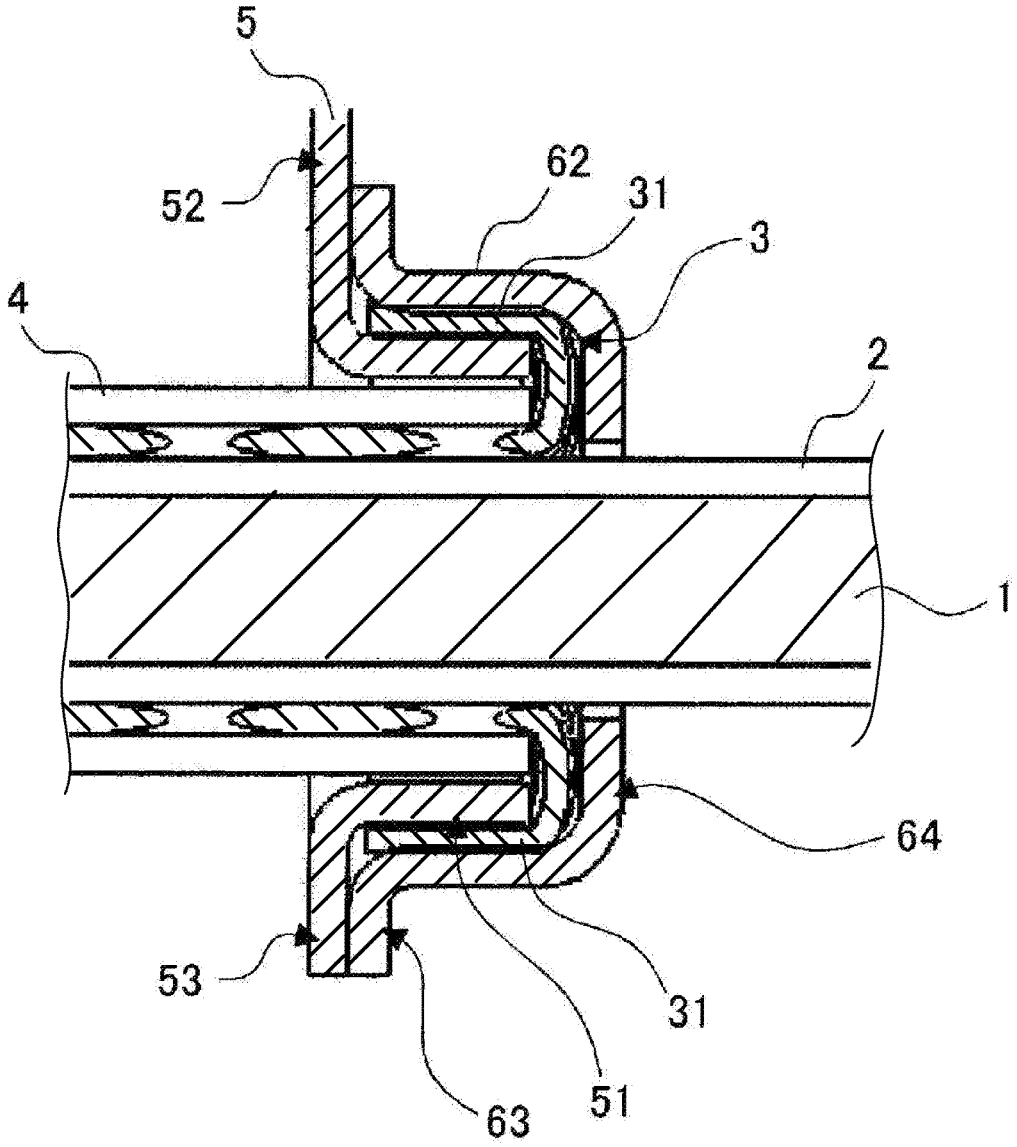
FIG. 11 is a drawing of a longitudinal cross sectional view of a point designated by arrows A10 in FIG. 10B when viewed in a direction of the arrows.

In the connection structure, the twined cables 31 are crimped to the outer periphery of the connector portion 51 by swaging the ring member 6. However, another acceptable technique is to crimp the twined cables 31 to the outer periphery of the connector portion 51 without swaging the ring member. FIGS. 10A, 10B, and 11 show an example of a connection structure using such a ring member. FIGS. 10A and 10B are drawings showing a connection structure along an example of procedures for connecting the external conductor terminal 5 to the external conductor 3 of the electric cable C, and FIG. 11 shows, in a direction of arrows, a longitudinal cross sectional view of a point designated by arrows A10 in FIG. 10B that shows a state achieved after the external conductor terminal 5 is connected to the external conductor 3 of the electric cable C.

In this case, a ring member 62 assumes a cylindrical shape whose inner diameter is set so as to become slightly larger than the diameter of the turned-up portions of the twined cables 31 of the external conductor 3. The ring member 62 has a diameter-expanded flange (a disk-shaped projection) 63 that juts out from an entire circumference of a brim of an opening at one end of the ring member 62 in its cylinder axis direction to a direction of diameter expansion. In addition to the diameter-expanded flange 63, the ring member 62 also a diameter-reduced flange (a disk-shaped projection) 64 that juts out from an entire circumference of the brim of the opening at the other end of the ring member 62 in a direction of diameter reduction. The essential requirement for a length to which the diameter-expanded flange 63 juts out in the direction of diameter expansion is to be set in such a way that a circumference of the diameter-expanded flange 63 becomes flush with the circumference of the flange 53 while the diameter-expanded flange 63 is held in close contact with the flange 53 of the external conductor terminal 5 (see FIG. 11) when the ring member 62 is crimped to the outer periphery of the external insulator 4 of the electric cable C by way of the twined cables 31 of the external conductor 3 and the connector portion 51 of the external conductor terminal 5. The essential requirement is to set a length to which the diameter-reduced flange 64 juts out in the direction of diameter reduction such that an inner diameter of the ring member 62 whose diameter is reduced by the diameter-reduced flange 64 become slightly larger than the outer diameter of the inner insulator 2 of the electric cable C (see FIG. 11).

On occasions when the external conductor terminal 5 using the ring member 62 is connected to the external conductor 3 of the electric cable C, work operation analogous to that shown in FIGS. 7A to 7C is first performed. In this case, work operation has common details except the ring member 6 is replaced by the ring member 62.

FIG. 10A shows a state of the electric cable C achieved after work operation which is the equivalent of that shown in FIGS. 7A to 7C is performed by use of the ring member 62. In this state, as in the case with the electric cable shown in FIG. 7D, the external conductor terminal 5 is positioned such that the twined cables 31 of the external conductor 3 remain in contact with the outer periphery of the connector portion 51; namely, that the connector portion 51 is inserted and interposed between the twined cables 31 of the thus-bared external conductor 3 and the outer periphery of the internal insulator 2. After the external conductor terminal 5 is thus positioned, the electric cable is inserted from it cable end side into the ring member 62.

FIG. 10B shows a state of the electric cable C achieved after the ring member 62 fitted around the electric cable C is moved toward the cable base end side. As shown in FIG. 10B, the ring member 62 fitted around the electric cable C is moved toward the cable base end side along the electric cable C, thereby fitting around the outer peripheries of the twined cables 31 of the external conductor 3 turned so as to be in contact with the outer periphery of the connector portion 51. On the occasion, the ring member 62 is press-fitted toward the cable end side while bringing an inner periphery of the ring member 62 in contact with an outer peripheries of the twined cables 31 such that the turned-up twined cables 31 are interposed between the inner periphery of the ring member 62 and the outer periphery of the connector portion 51 of the external conductor terminal 5. The ring member 60 is press-fitted toward the cable end side until the diameter-expanded flange 63 contacts the flange 53 of the external conductor terminal 5. As shown in FIG. 11, in the ring member 62, the diameter-expanded flange 63 comes into close contact with the flange 53 of the external conductor terminal 5 in this state, whereby the ring member 62 is crimped to the outer periphery of the external insulator 4 of the electric cable C by way of the twined cables 31 of the external conductor 3 and the connector portion 51 of the external conductor terminal 5. As a consequence, the twined cables 31 are crimped to the outer periphery of the connector portion 51, so that the external conductor terminal 5 and the external conductor 3 can be connected to each other. In this state, the turned-up twined cables 31 remain sandwiched between the flange 53 of the external conductor terminal 5 and the diameter-reduced flange 64 of the ring member 62. Therefore, after the twined cables 31 of the external conductor 3 are crimped to the connector portion 51 while the ring member 62 remains fitted around the twined cables 31, the twined cables 31 of the external conductor 3 are not laid bare outside. Moreover, as in the case with the electric cable shown in FIG. 7F, the internal conductor terminal 7 is connected to the bared internal conductor 1. In this respect, the technique for connecting the internal conductor terminal 7 to the internal conductor 1 and handling the configuration of the internal conductor terminal 7 are analogous to their counterparts described in connection with the case of the connection structure that uses the aforementioned ring member 6.

As above, according to the first embodiment (FIGS. 1A to 1E, FIG. 2, FIGS. 3A and 3B, FIG. 4, FIGS. 5A and 5B, and FIG. 6) and the second embodiment (FIGS. 7A to 7F, FIGS. 8 and 9, FIGS. 10A and 10B, and FIG. 11), the area in the connected portion of the external conductor terminal 5 where the external conductor 3 (the twined cables 31) are laid bare can be made narrow. The size of the area where the external conductor terminal 5 is connected to the external conductor 3 can be made small. Moreover, work for twisting the plurality of twined cables 31 becomes unnecessary for connection, so that efficiency of connecting work and connection quality can be enhanced.

It is apparent that various modifications can be made in the invention within a scope not deviating from the gist of the invention.

The present invention is useful for providing a connection structure of an external conductor terminal of an electric cable that has advantages of a size of an area on the connector portion of the external conductor terminal where the external conductor is laid bare being made small, and efficiency of work for connecting the external conductor terminal to the external conductor and connection quality being enhanced.

What is claimed is:

1. A connection structure comprising:

an external conductor terminal;

an electric cable connected to the external conductor terminal, the electric cable comprising one or a plurality of internal conductors connected to an internal conductor terminal, and an external conductor including twined cables provided so as to enclose an outer periphery of an insulating coating of one or a plurality of the internal conductors and a protective coating which covers an outer periphery of the external conductor, wherein the external conductor terminal further comprises a cylindrical connector portion configured to be connected to the external conductor and a terminal portion provided at one end of the connector portion in its cylinder axis direction and integrally connected to the cylindrical connector portion;

the connector portion of the external conductor terminal is fitted to a location on an outer periphery of the insulating coating, between the twined cables and an unexposed portion of the insulating coating, where the external conductor is laid bare by peeling off the protective coating or an outer periphery of the protective coating at another location contiguous to the location, the twined cables of the external conductor are provided in contact with an outer periphery of the connector portion, and a ring member, having an inner diameter larger than a diameter of the electric cable and a length shorter than the location where the external conductor is laid bare, is fitted around outer peripheries of the twined cables, without contacting the protective coating, and the twined cables of the external conductor are crimped to the outer periphery of the connector portion.

2. The connection structure of claim 1, wherein the terminal portion assumes a shape of a flat plate in a direction that crosses the cylinder axis direction of the connector portion and is stretched from a brim at one end of the connector portion in a direction of diameter expansion.

3. The connection structure of claim 1, wherein the ring member has a diameter-expanded flange that extends from a brim of an opening at one end in a direction of diameter expansion or, in addition to having the diameter-expanded flange, a diameter-reduced flange that extends from a brim of an opening at the other end in a direction of diameter reduction.

4. The connection structure of claim 3, wherein the ring member further has a diameter-reduced flange that extends from the brim of the opening at the other end in a direction of diameter reduction.

5. The connection structure of claim 1, wherein a portion of the external conductor is laid bare from the ring member and the protective cover through a gap between the ring member and the protective coating.

6. The connection structure of claim 5, wherein the gap extends in an insertion direction of the external conductor into the external conductor terminal.

7. The connection structure of claim 1, wherein a length of a portion of the external conductor that is laid bare is greater than a total length of the connector portion in an insertion direction of the external conductor into the external conductor terminal.

8. The connection structure of claim 1, wherein a first end surface of the cylindrical connector portion, in a longitudinal direction of the cylindrical connector portion, is directly connected to and is integral with the terminal portion, and a second end surface of the cylindrical connector portion, opposing the first end surface, is extended from the terminal portion towards the protective coating.

9. The connection structure of claim 1, wherein the connection portion has a flange that extends from an entire circumference of a brim of an opening at one end of the connector portion in a cylinder axis direction, and the terminal portion extends from the brim of the flange in the direction of diameter expansion.

10. The connection structure of claim 1, wherein the connection portion has a flange that extends from an entire circumference of a brim of an opening at one end of the connector portion in a cylinder axis direction, and the terminal portion has a projection portion that extends from the brim of the flange in the direction of diameter expansion and extends along the lengthwise direction of the electric cable from a leading end of the projection portion.

11. The connection structure of claim 1, wherein the connection portion has a flange that extends from an entire circumference of a brim of an opening at one end of the connector portion in a cylinder axis direction, and the terminal portion has a projection portion that extends from the brim of the flange in the direction of diameter expansion and extends along a direction perpendicular to the lengthwise direction of the electric cable from a leading end of the projection portion.

* * * * *